United States Patent [19]

Ingram

[11] 4,005,797

[45] Feb. 1, 1977

[54] CARD FILE DRAWER FOR APERTURED INDEX CARDS

[75] Inventor: Harold M. Ingram, Williamsport, Pa.

[73] Assignee: Bro-Dart Inc., Williamsport, Pa.

[22] Filed: Jan. 28, 1976

[21] Appl. No.: 653,041

[52] U.S. Cl. ..... 220/22.5; 312/183

[51] Int. Cl.[2] ..... B65D 01/24; B42F 17/16

[58] Field of Search ..... 312/183, 184, 189, 190, 312/302, 303, 330; 221/226; 402/26–28, 46, 502; 220/22.1–22.6

[56] References Cited

UNITED STATES PATENTS

| | | | |
|---|---|---|---|
| 2,501,491 | 3/1950 | Beno | 220/22.5 |
| 3,550,979 | 12/1970 | Protzmann | 312/330 |
| 3,729,115 | 4/1973 | Little | 220/22.5 |

*Primary Examiner*—Casmir A. Nunberg
*Attorney, Agent, or Firm*—Alan H. Levine

[57] ABSTRACT

A molded plastic card file drawer having a bottom wall, two side walls, a back wall, and a front wall. A rib extends along the upper edge of each side wall, the ribs projecting toward each other and being spaced apart a distance equal to the length of the cards with which the drawer is to be used. A support for cards within the drawer has end pieces each slidably arranged between one of the ribs and the drawer bottom wall. A space is provided between the front end of each rib and the drawer front wall to permit the support end pieces to pass through as the support is being inserted into the drawer. The front wall and support have aligned holes for accommodating a bar which passes through similar holes in the cards. The support may be locked in different selected positions along the length of the drawer.

6 Claims, 5 Drawing Figures

CARD FILE DRAWER FOR APERTURED INDEX CARDS

This invention relates to drawer for containing files of apertured index cards, such as the card file drawers used with library card catalog cabinets.

The invention is intended for use particularly with library card catalogs. However, it obviously has wider utility, can be employed, for example, with any type of file cards, and even with cards which carry holders for audiotape cassettes. Therefore, although for illustrative purposes a library card catalog is referred to below, the invention is not so limited.

In the past, card catalog drawers have been made of wood, as have the cabinets into which the drawers fit. While the cabinets continue to be made of wood, in some cases the drawers have more recently been made of molded plastic, each drawer often carrying a wooden front face so that when the drawers are closed the card catalog appears to be all wood. However, plastic front faces have also been used.

Use of plastic file card drawers has presented a number of problems. When such a drawer is filled with cards and is pulled about two-thirds of its length out of the cabinet, and left without support other than the one-third remaining in the cabinet, the combined weight of the drawer and cards causes the drawer to flex both along and transverse to its length. The strain placed upon the drawer side walls by the flexing action causes the drawer to become non-linear, and hence difficult to slide into and out of the cabinet.

In addition, since the thickness of the molded plastic drawer side walls is less than the thickness of earlier wooden side walls, the interior dimension between the side walls is somewhat larger than the length of the file cards accommodated by the drawer. Library catalog cards, which are about five inches long and three inches wide, all have holes near their bottom edges and on the vertical conterline of the cards. A rod extends along the length of the drawer and passes through all the holes in the cards so as to prevent any card from being removed from the drawer. When the internal width of the drawer is larger than the length of the cards, there is room for the cards to shift laterally with respect to each other when a large group of cards is placed in the drawer, or even when one additional card is placed into a drawer already filled with cards. As a result, it is difficult to align all the holes in the cards and hence when the rod is inserted, it pierces and tears those cards whose holes are not aligned. To avoid this problem, the librarian is often forced to insert the rod through a few cards at a time, making loading of the drawer a very time consuming project.

Furthermore, card catalog drawers are always provided with a support slidable along the length of the drawer for supporting the rear end of a group of cards in the drawer, and also serving as the support for the rear end of the rod passing through the card holes. This support is usually held in the plastic drawer by slidably engaging a groove in the bottom wall of the drawer. However, the interengagement of support and bottom wall is not firm, and when the drawer is dropped the support often pops out of the drawer taking the rod and cards with it. Thereafter, the cards must be arranged again in proper order and replaced in the drawer with the rod extending through all the card holes.

It is an object of the present invention to overcome all these problems by means of a relatively simple innovation in the structure of a plastic card catalog drawer.

Specifically, according to the invention, a strengthening rib is provided along the length of the upper edge of each side wall of the drawer. These ribs reduce the amount of flexing of the drawer, and inhibit the drawer from becoming non-linear, so that it remains easy to slide into the cabinet.

The ribs project toward each other, and are spaced apart a distance equal to the length of the file cards. As a result, when cards are placed in the drawer, their side edges are held snugly between the ribs and hence the holes in all the cards are automatically aligned so that the rod can easily be passed through all the holes without damaging any of the cards.

The drawer of this invention is used with a support comprising a member extending crosswise of the drawer body and an end piece at each end of the member. Each end piece fits slidably against the underside of one of the ribs, and the support is thereby held firmly, yet slidably, within the drawer. There is no way that the support end pieces can pop out from beneath the ribs, and hence the support remains assembled with the drawer even when the latter is dropped.

Additional objects and features of the invention will be apparent from the following description, in which reference is made to the accompanying drawings.

Figures 1, 2, 3:
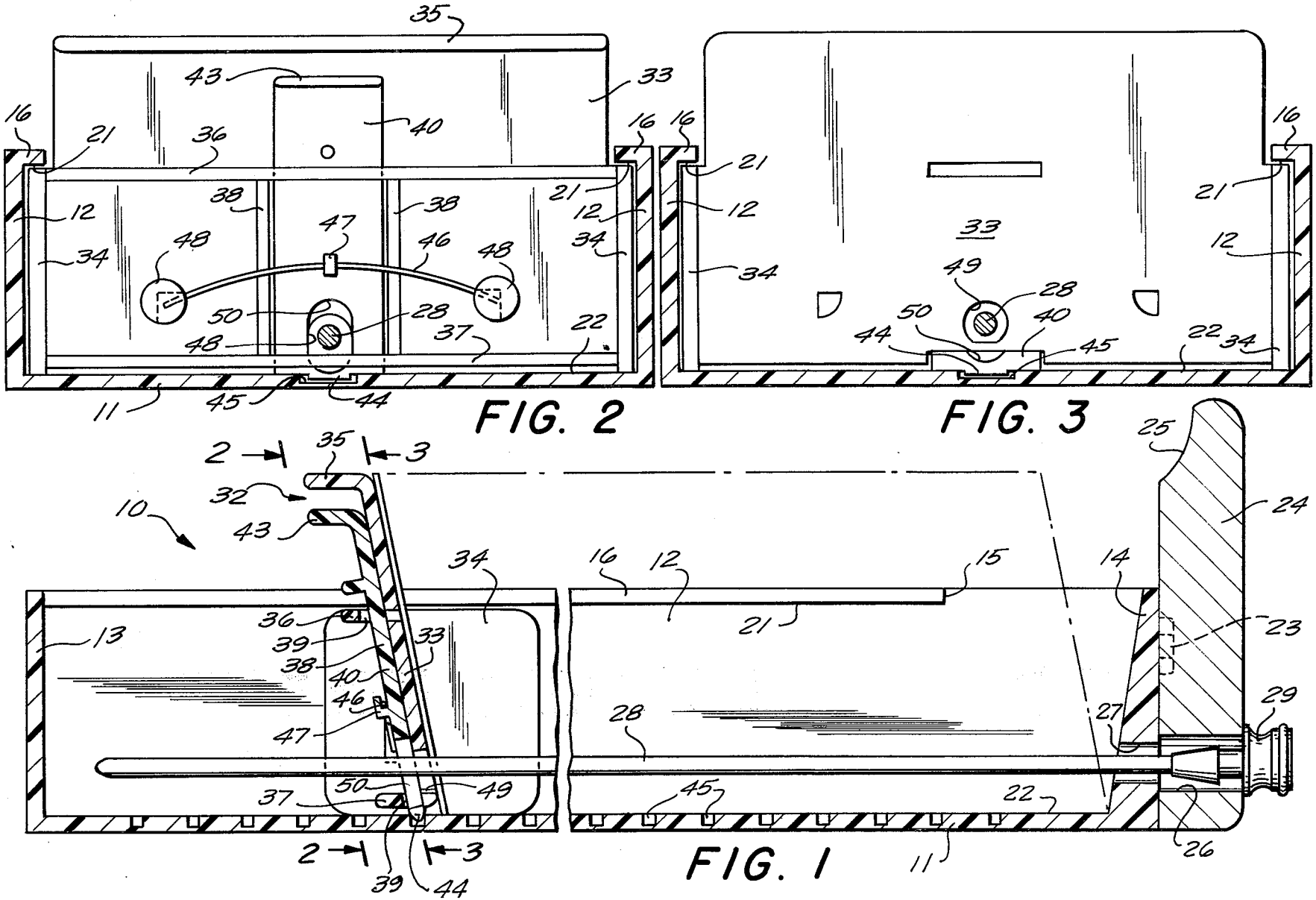
FIG. 1 is a longitudinal cross-sectional view through a library card catalog drawer according to the present invention.
FIG. 2 is a cross-sectional view taken along line 2—2 of FIG. 1.
FIG. 3 is a cross-sectional view taken along line 3—3 of FIG. 1.

The library card catalog drawer chosen to illustrate the present invention includes a body portion 10 comprising a bottom wall 11, two side walls 12, a back wall 13, and a front wall 14. Extending along the upper edge of each side wall 12, from the rear wall 13 to a point 15 (FIG. 1) spaced from front wall 14, is an inwardly projecting rib 16. The walls 11–14 and ribs 16 of the body portion 10 are all formed as a one-piece unit of a suitable rigid molded plastic.

Figure 4:
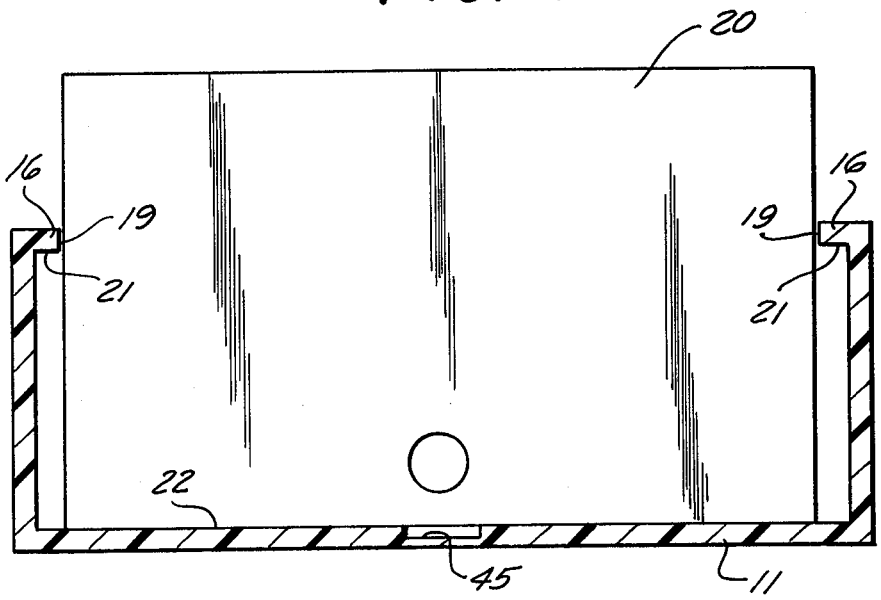
FIG. 4 is a face view of a file card within the drawer.
Figure 5:
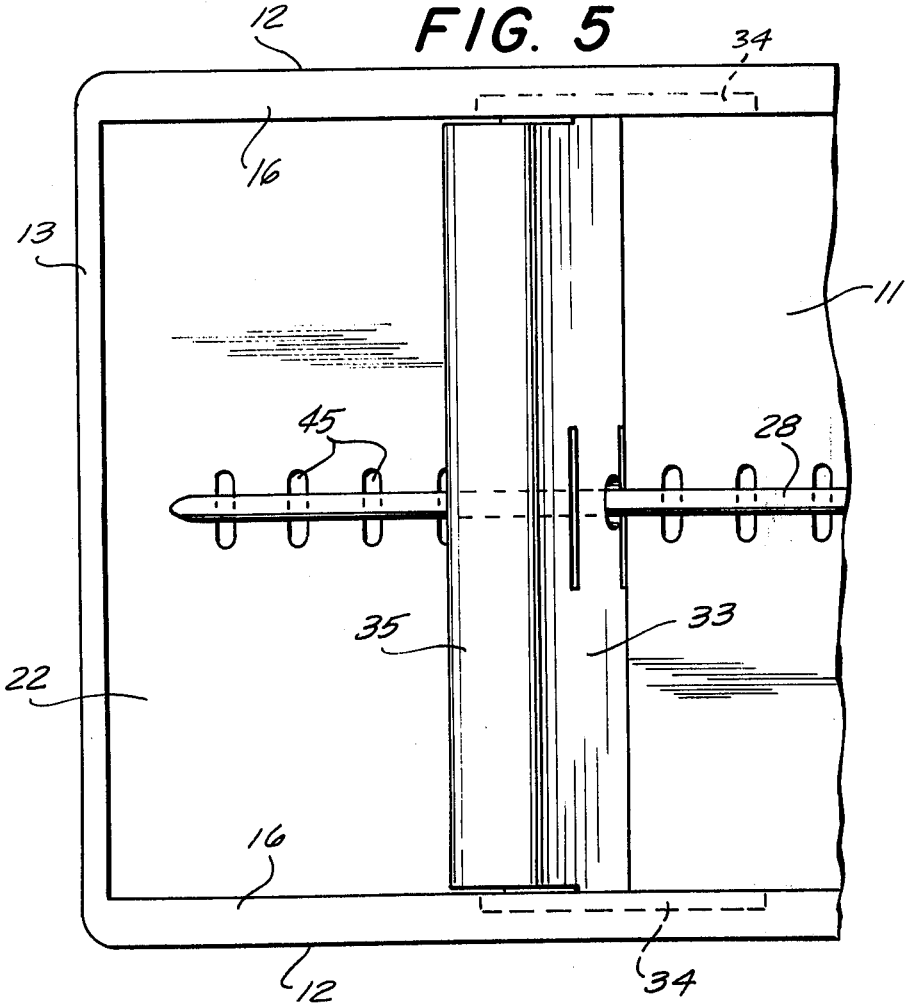
FIG. 5 is a frequentary top plan view of the rear portion of the drawer shown in FIG. 1.

The spacing between the inner edges 19 (FIG. 4) of ribs 16, measured in a direction perpendicular to the longitudinal axis of the drawer, is equal to the length of a book catalog file card 20 which is to be accommodated by the drawer body 10. When the word "equal" is used herein and in the appended claims, it is meant to indicate that the two dimensions being referred to are as close to equal as possible while still permitting relative movement between the parts. Thus, there is the slightest spacing between each end of card 20 and the corresponding edge 19 of rib 16 so as to permit card 20 to be moved along the length of drawer body 10.

Ribs 16 preferably have a squared-off cross-sectional shape (FIGS. 2–4) so that each rib presents a flat lower surface 21 parallel to the upper surface 22 of bottom wall 11. Fixed to the front surface of front wall 14, by means of screws 23, is a facing 24 (FIG. 1) of wood or any other suitable material, such as plastic. The facing serves a decorative purpose, and is also notched out at its upper and inner end to provide a finger grip 25 for withdrawing the drawer from the cabinet. Facing 24 and front wall 14 are furnished with aligned holes 26 and 27, respectively, through which a straight metal rod 28 passes. The front portion of rod 28 is adapted to threadably engage hole 26 (the threaded interengagement not being shown), and an external knob 29 is used to manipulate the rod to engage and disengage it with the drawer.

Arranged for longitudinal sliding movement within drawer body 10 is a support 32 for the rear end of a group of file cards 20 contained by the drawer body 10. Support 32 comprises a generally flat plate-like member 33 extending crosswise of drawer body 10, and a generally rectangular plate-like end piece 34 fixed to each end of member 33, the end pieces being in planes perpendicular to the plane of member 33. Perferably, member 33 and end pieces 34 are formed as a one-piece unit of a suitable rigid molded plastic. The upper edge of member 33 is bent rearwardly to define a finger grip 35. The vertical dimension of each end piece 34 equals the vertical distance between the lower surface 21 of each rib 16 and the top surface 22 of bottom wall 11. As a result, each end piece 34 is snugly but slidably accommodated between one of the ribs 16 and bottom wall 11. The distance between the front end 15 of each rib 16 and front wall 14 is a little larger than the horizontal dimension of each end piece 34 so that the end pieces can pass between the ribs and front wall when support 32 is inserted into the drawer body, after which the support is moved rearwardly.

On its rear face, member 33 is formed with a horizontal ridge 36 (FIGS. 1 and 2), at about the level of the top of end pieces 34, and a horizontal ridge 37, at about the level of the bottom of end pieces 34, both ridges extending between the end pieces. Two vertical ridges 38 extend between the two horizontal ridges 36 and 37. A locking bar 40 is slidably arranged between vertical ridges 38, and passes slideably through slots 39 in horizontal ridges 36 and 37. The upper end of locking bar 40 is bent rearwardly to form a finger grip 43. The lower end of bar 40 is formed with a tongue 44 adapted to fit into each of a series of depressions 45, in the upper surface 22 of bottom wall 11, spaced apart along the length of drawer body 10.

A Springy wire 46 is seated at about its midpoint within an upwardly facing hook-shaped projection 47 extending from the rear face of locking bar 40. The ends of wire 46 are seated beneath two abutments 48 projecting from the rear face of member 33 on each side of ridges 38. Springy wire 46 constantly urges locking bar 40 downwardly with respect to member 33 and hence serves to maintain tongue 44 in engagement with any one of the depressions 45 within which the tongue is seated. As a result, support 32 is locked in that particular position of adjustment. When it is desired to move support 32, finger grips 35 and 43 are gripped between two fingers and squeezed together. This causes locking bar 40 to move upwardly and tongue 44 to move out of the depression 45 accommodating it. Support 32 is then free to slide along the length of drawer body 10 to a new position, at which point finger grips 35 and 43 are released. The support is then moved slightly along the length of the drawer until tongue 44 snaps into one of the depressions 45 under the action of springy wire 46.

Member 33 and locking bar 40 are provided with holes 49 and 50, respectively, both of which are aligned with holes 26 and 27. Holes 49 and 50 accommodate rod 28, and serve to support the rear portion of the rod. Hole 50 in locking bar 40 is made vertically elongated so that bar 40 can slide vertically without interference from rod 28.

It will be appreciated from the description above that the ribs 16 perform three important functions simultaneously. First, they strengthen the upper edges of side walls 12 of drawer body 10. Second, they snugly accommodate the file cards between them so that all the holes in the file cards are assuredly aligned. Thirdly, together with the drawer bottom wall, they define guideways for snugly, but slideably, accommodating the end pieces of the card and rod support 32 in such a way that the support cannot accidently become dissambled from the drawer body.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A card file drawer comprising:
   a. an elongated drawer body having a bottom wall, two side walls, a back wall, and a front wall, the top of the drawer being open,
   b. a rib extending along the upper edge of each side wall, said ribs projecting inwardly toward each other and being spaced apart a distance equal to the length of the cards with which the drawer is used,
   c. a support within said drawer body for supporting the rear end of a group of cards in the drawer, said support including a member extending crosswise of the drawer body and an end piece at each end of said member, each end piece being a plate-like element having parallel upper and lower edges, the distance between the outer faces of said end pieces being equal to the distance between the inner faces of said drawer side walls, and the distance between the upper and lower edges of each end piece being equal to the distance between each rib and the drawer bottom wall, whereby said upper and lower edges are slidably and non-rotatably arranged against said rib and bottom wall, respectively, and
   d. aligned holes in the drawer front wall and in said support, and a rod passing through both of said holes, said rod also passing through aligned holes in any cards which may be in the drawer so as to prevent removal of the cards from the drawer.

2. A card file drawer as defined in claim 1 wherein each of said ribs terminates at a point spaced from the drawer front wall, the spaces between said points and the front wall being large enough to permit said end pieces to pass through so that said support can be inserted into said drawer body.

3. A card file drawer as defined in claim 1 including means for locking said support in any one of a plurality of selected positions along the length of said drawer body.

4. A card file drawer as defined in claim 3 wherein said locking means includes a series of depressions in said drawer bottom wall spaced apart along the length of the drawer body, and a locking member carried by said support, said locking member being slidable toward and away from said bottom wall and having a lower end adapted to be accommodated by any selected one of said depressions.

5. A card file drawer as defined in claim 4 including resilient means constantly urging said locking member toward said drawer bottom wall.

6. A card file drawer as defined in claim 1 wherein said drawer walls and ribs are a one piece molded plastic unit.

* * * * *